US008864332B2

(12) United States Patent
Ter-Hovhannisyan

(10) Patent No.: US 8,864,332 B2
(45) Date of Patent: Oct. 21, 2014

(54) PASSIVE COOLING LIGHTING FIXTURE

(75) Inventor: Zorak Ter-Hovhannisyan, Burbank, CA (US)

(73) Assignee: Light Emitting Design, Inc., Burbank, CA (US)

( * ) Notice: Subject to any disclaimer, the term of this patent is extended or adjusted under 35 U.S.C. 154(b) by 401 days.

(21) Appl. No.: 13/420,036

(22) Filed: Mar. 14, 2012

(65) Prior Publication Data

US 2013/0242548 A1 Sep. 19, 2013

(51) Int. Cl.

| | |
|---|---|
| ***F21V 29/00*** | (2006.01) |
| ***F21V 21/02*** | (2006.01) |
| ***F21S 8/06*** | (2006.01) |
| ***F21V 15/01*** | (2006.01) |
| *F21Y 103/00* | (2006.01) |
| *F21S 8/02* | (2006.01) |
| *F21V 3/04* | (2006.01) |
| *F21V 15/015* | (2006.01) |

(52) U.S. Cl.

CPC ..... *F21V 29/2293* (2013.01); *F21V 15/011* (2013.01); *F21Y 2103/003* (2013.01); *F21S 8/026* (2013.01); *F21V 3/0445* (2013.01); *F21S 8/063* (2013.01); *F21V 15/015* (2013.01)

USPC ..... 362/218; 362/217.12; 362/223; 362/294; 362/373; 362/404

(58) Field of Classification Search

CPC ..... F21Y 2103/003; F21Y 2101/02; F21V 29/004; F21V 29/2293; F21V 29/2262; F21V 29/2206; F21V 15/01; F21V 29/246; F21V 29/00; F21V 29/2212; F21V 29/20; F21V 29/002; F21V 15/015; F21V 15/011; F21V 3/0445; F21V 15/013; F21V 21/00; F21S 8/026; F21S 8/063; F21S 8/06

USPC ..... 362/218, 217.1, 217.11, 217.12, 362/217.14, 217.15, 217.16, 217.17, 223, 362/225, 249.02, 294, 373, 147, 382, 404, 362/408

See application file for complete search history.

(56) References Cited

U.S. PATENT DOCUMENTS

| | | | | |
|---|---|---|---|---|
| 7,604,379 | B2 * | 10/2009 | Stenback et al. | 362/260 |
| 7,926,985 | B2 * | 4/2011 | Teng et al. | 362/373 |
| 8,167,466 | B2 * | 5/2012 | Liu | 362/373 |
| 8,197,089 | B2 * | 6/2012 | Chang et al. | 362/249.02 |
| 8,256,927 | B2 * | 9/2012 | Hu et al. | 362/294 |
| 8,360,613 | B2 * | 1/2013 | Little, Jr. | 362/294 |

* cited by examiner

*Primary Examiner* — Alan Cariaso

(74) *Attorney, Agent, or Firm* — Kelly & Kelley, LLP

(57) ABSTRACT

A passive cooling lighting fixture that includes a light diffusing lens. The fixture is self-contained and self-cooled in order to maximize the life span of the light source. The passive cooling system utilizes vented end caps that circulate cool air into the lighting fixture while venting hot air out of the lighting fixture. The light diffusing lens produces a light that is soft enough for use indoors.

20 Claims, 7 Drawing Sheets

PASSIVE COOLING LIGHTING FIXTURE

BACKGROUND OF THE INVENTION

The present invention generally relates to lighting apparatuses. The incandescent light bulb has been the light bulb standard in both commercial and residential lighting applications for more than one hundred years. The incandescent light bulb was invented in the early 1800's, but it did not become commonly used until the late 1800's. The incandescent light bulb creates light when an electric current is passed through a filament that is suspended in a vacuum. The resistivity of the filament causes the filament to heat up and glow as the electric current passes through it. Incandescent light bulbs are relatively inexpensive and easy to manufacture in a variety of shapes and sizes. Despite this, incandescent light bulbs are falling out of favor because of the energy required to power them. There are laws in place in the United States that will cause the use of incandescent light bulbs to be slowly phased out in coming years. Additionally, incandescent light bulbs can become very hot if left on for long periods of time, and they burn out and have to be replaced every 1000 to 2000 hours of use.

Fluorescent light bulbs have also become very common over the last several decades. Fluorescent light bulbs are generally constructed out of long glass tubes. The tube is filled with a gas containing mercury vapor and argon, xenon, neon, or krypton under pressure. The inner surface of the tube is coated with a fluorescent material. The tube also contains a coiled electrode that emits electrons which in turn excite the mercury vapor. The excited mercury atoms produce short-wave ultraviolet light which causes inner coating of the tube to fluoresce, producing visible light. Fluorescent light bulbs last longer than incandescent light bulbs (typically 10 times longer) and require less energy to operate. Additionally, fluorescent light bulbs do not get as hot as incandescent light bulbs. Despite these advantages, fluorescent lights are not universally favored. Fluorescent lights take longer to turn on, and tend to flicker as the tube gets old. Also, the light produced by a fluorescent bulb is often considered to be glaring and not ideal for use by those with sensitive eyes.

The newest light source to come into use in recent years is the Light Emitting Diode, commonly called an LED. LEDs are miniature semi-conductors that produce light when electrons are allowed to recombine with electron holes within the device, releasing energy in the form of photons. Different colors of light are created by changing the type of semiconductor, as well as changing the color of the plastic housing of the LED. LEDs are attractive as a light source because they emit more light per watt than incandescent light bulbs and their efficiency is not affected by shape or size like a fluorescent light bulb. LEDs last much longer than both incandescent and fluorescent light bulbs. LEDs light up very quickly and are ideal for frequent on-off cycling. Also, LEDs are made of solid-state components, so they are very shock resistant unlike incandescent and fluorescent light bulbs which are extremely fragile.

Despite the advantages of LEDs lights, LEDs still have some problems. First, the light produced by an LED is very bright and often too harsh for use in-doors. Additionally, LED performance is largely dependent on the ambient temperature of the environment where it is operating. If the LED is operating in a warmer environment, the device will fail due to overheating. For this reason, LED lights require adequate heat sinking in order to maintain long life. A heat sink is a separate device that transfers heat generated within the LED to a fluid medium, usually air. The most efficient heat sinks are ones that move air across a heated area in order to cool it down. But including a fan in an LED assembly is impractical because of size and power restrictions.

Accordingly, there is a need for an LED lighting apparatus that creates a softer light source that is more appropriate for indoor use. Additionally, there is a need for an LED lighting apparatus that effectively sinks the heat away from the LED light so that the lifetime of the LED can be maximized.

SUMMARY OF THE INVENTION

The present invention is a passive cooling lighting fixture that utilizes an LED light source. This passive cooling lighting fixture provides a filtering lens that diffuses the harsh LED light source creating light that is appropriate for indoor use. The passive cooling lighting fixture also features an innovative heat sinking system that allows the LED light source to stay cool. The heat sinking system includes double walled, vented end caps that fit over the ends of lighting fixture as well as a double walled portion of the lighting fixture that draws heat away from the LED lights. Some of the vents in the end caps are oriented at the base of the end cap, nearest the base of the lighting fixture where the LED lights are situated. The rest of the vents in the end caps are oriented at the distal end of the end cap. The end caps also feature inner ports toward the base end of the end cap. The lighting fixture is also partially double walled so that the heat generated from the LED light source is sinked away from the LEDs by air held in an inner chamber created by the double walled portion. The double walled, vented end caps ends of the lighting fixture are positioned such that the inner ports are over the ends of the inner chamber. With the double walled, vented end caps in place, cool air from outside the lighting fixture is circulated through the inner chamber. This cools and moves the hot air away from the LED light components. The heat sink is reminiscent of human sinuses, which heat incoming air to body temperature, in that it uses air to conduct heat away from a heat producing source. The heat sinking system of the present invention does not include any moving parts so it does not require any extra power. Additionally, it does not create any noise.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The present invention is a passive cooling lighting fixture that overcomes the negative aspects of LED lights by providing a fixture with a lens that diffuses the harsh light created by an LED. Additionally, the present invention solves the heating problem common to LED lights by providing a passive heat sink that is silent and requires no extra power considerations. These and other features of the present invention will be described in more detail below.

Figure 1:
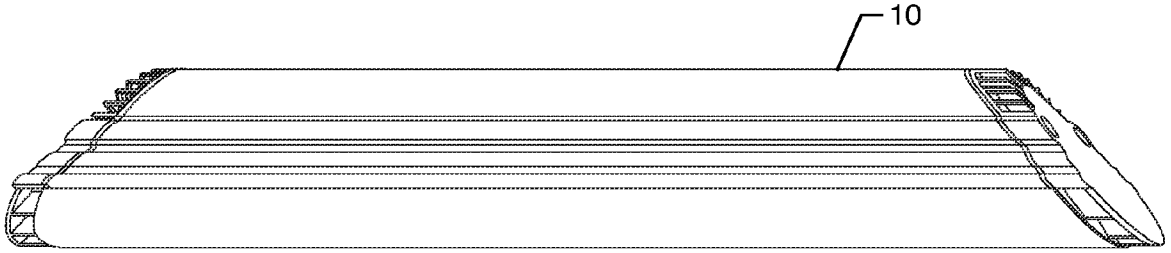
FIG. 1 is a side view of the present invention.

FIG. 1 is a side view of the passive cooling lighting fixture 10 of the present invention. Here it can be seen that the various parts and pieces of the lighting fixture 10 are all contained within the lighting fixture 10. The size of the lighting fixture 10 as shown in the preferred embodiment is small enough to fit within a standard panel of a drop-down ceiling, but in other embodiments, the lighting fixture 10 can be larger or smaller.

Figure 2:
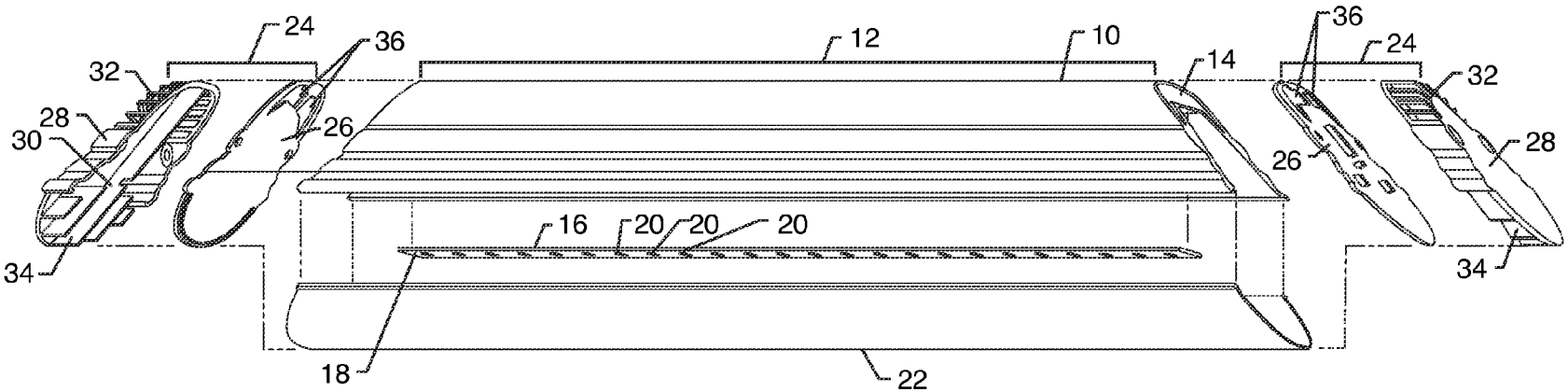
FIG. 2 is an exploded perspective view of the present invention of FIG. 1.

FIG. 2 is an exploded side view of the passive cooling lighting fixture 10 of FIG. 1. FIG. 2 illustrates more particularly the various parts that are included in the lighting fixture 10. First, the main body of the lighting fixtures 10 is made of a rigid channel 12. The rigid channel 12 is made of aluminum in the preferred embodiment, but in other embodiments the rigid channel 12 can be made of other materials. Ideally, the rigid channel 12 is made from a material that will hold its shape even when heated. The rigid channel 12 in the preferred embodiment is also double walled along the outside of the base of the channel 12. This double walled portion of the channel 12 creates an inner chamber 14. The inner chamber 14 does not open into the channel 12 at any point, but is open at both ends of the channel 12.

Next, the light source 16 is shown. In the preferred embodiment, the light source 16 is a series of surface mounted LEDs 20 that are placed along a strip 18. A plurality of LEDs 20 are mounted to the strip 18. The strip 18 is long enough to run the length of the channel 12, but not longer than the channel 12. In the preferred embodiment, the strip 18 is mounted into the channel 12 along the side of the channel 12 that that is double walled. This is essential to the heat sinking function of the present invention in that the heat created along the strip 18 from the plurality of LEDs 20 is transferred into the inner chamber 14 of the double walled portion of the channel 12. The light diffusing lens 22 is the same length as the channel 12 so that it fits over the channel 12. In the preferred embodiment, the light diffusing lens 22 is rounded, but in other embodiments the light diffusing lens 22 can have any cross-sectional configuration (i.e. flat, concave, etc). The panel 22 can attach to the channel 12 with clips, clamps, screws or adhesive, but in the preferred embodiment, the panel 22 attaches to the channel 12 by sliding along a c-shaped concourse 58 (SEE FIG. 8) that allows the panel 22 to be inserted and removed horizontally, but holds the panel 22 in place vertically. In the preferred embodiment, the light diffusing lens 22 is made from opaque plastic, but in other embodiments, the panel 22 can be made from other light diffusing materials such as frosted glass.

Also featured in FIG. 2 are the double walled end caps 24 that function as heat sinks in the present invention. The end caps 24 are comprised of an inner wall 26 and an outer wall 28 that when put together create a hollow air passage 30. The end cap outer wall 28 features a series of base vents 32 located at the base of the channel, and distal vents 34. These vents function with the hollow air passage 30 to increase air flow through the end caps 24. The end cap inner wall 26 features two ports 36 that are positioned over the open ends of the inner chamber 14 created by the double walled portion of the channel 12. When the assembled end caps 24 are in place over the ends of the channel 12 such that the end cap inner ports 36 are over the ends of the inner chamber 14 created by the double walled portion of the channel 12, the heated air that accumulates inside the inner chamber 14 flows out of the inner chamber 14 through the ports 36. Once the heated air exits the inner chamber 14, it is circulated out of the end caps 24 by cooler air that passes through the end caps 24 via the base vents 32 and the distal vents 34 that are oriented along the end cap outer wall 28. Thus, the heat created by the LED light source 16 is successfully sinked away from the lighting fixture 10 without requiring the use of a fan or other noisy moving parts that would require extra power. The air flow pattern described above is specifically laid out in FIGS. 7-11 below.

Figure 3:
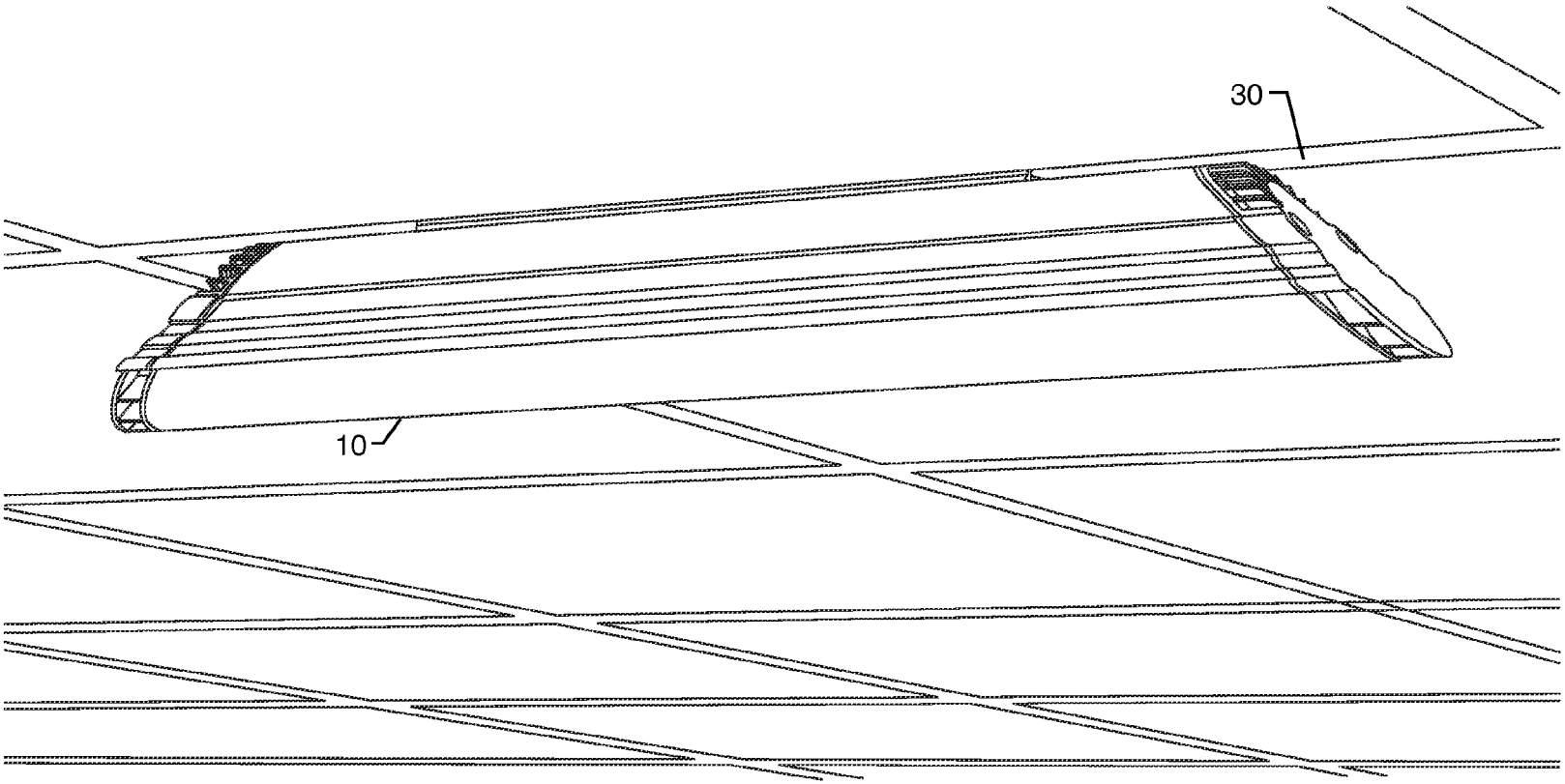
FIG. 3 is an environmental view of the present invention.

FIG. 3 is an environmental view of the present invention. Here, the passive cooling lighting fixture 10 is shown in its preferred embodiment with the length of the lighting fixture 10 being approximately the same as the length of a panel from a standard drop-down ceiling. This type of ceiling is common in commercial real estate such as office buildings and retail spaces. FIG. 3 shows that the lighting fixture 10 can be clipped onto the ceiling cross pieces 38. This makes the lighting fixture 10 particularly ideal for installation in spaces where a minimum amount of alteration to existing structures is desired.

Figure 4:
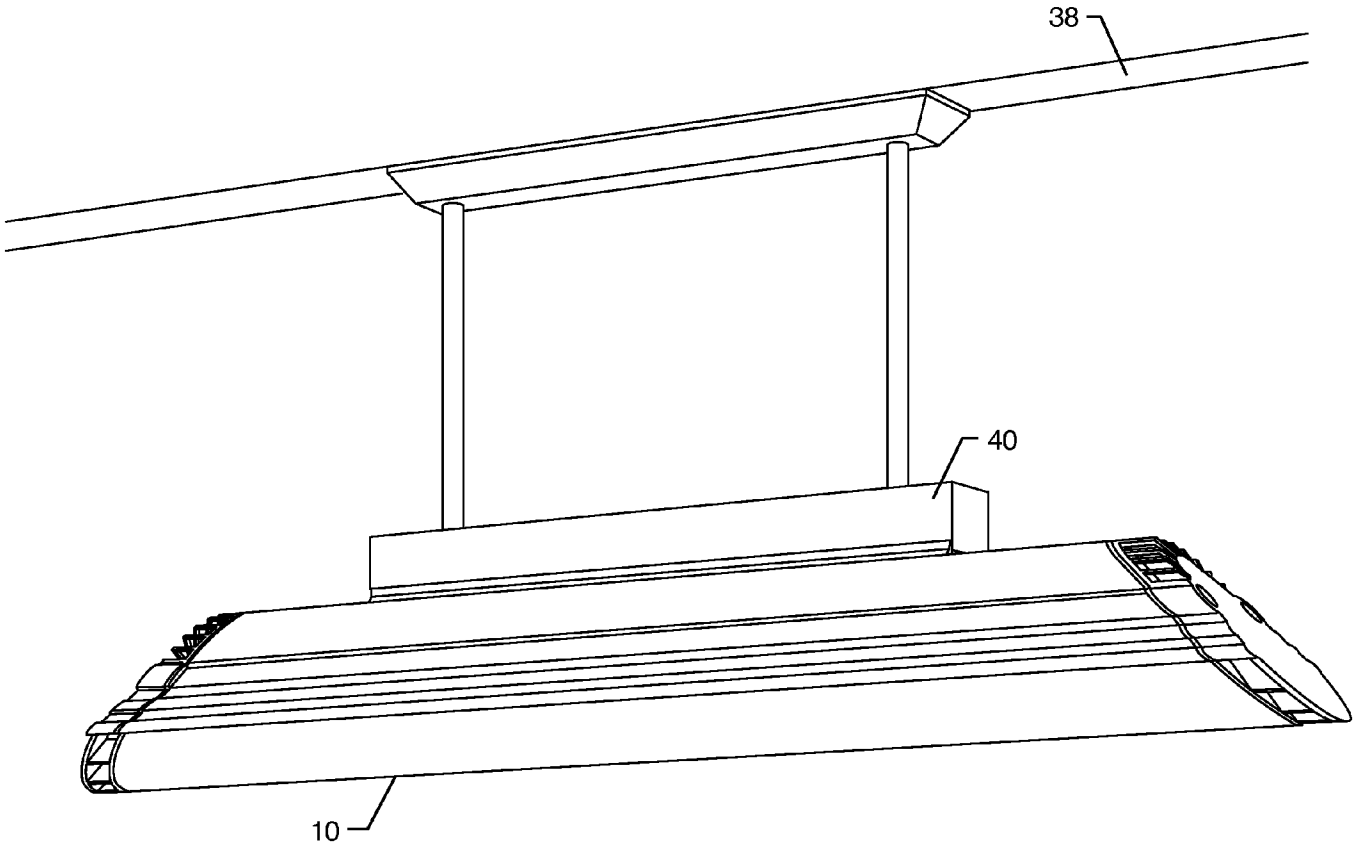
FIG. 4 is an environmental view of the present invention illustrating a frame from which the lighting fixture can be suspended.

FIG. 4 is yet another environmental view of the present invention. Here, the passive cooling lighting fixture 10 is attached to a frame 40 that allows the lighting fixture 10 to be suspended below the ceiling. The frame 40 attaches to the ceiling cross-pieces 38 via clips, clamps, screws or adhesive. In the preferred embodiment, the frame 40 attaches to the ceiling cross-pieces 38 with clips to allow for easy installation and removal of the lighting fixture 10. Likewise, in the preferred embodiment, the lighting fixture 10 attaches to the frame 40 with a clip that allows for the lighting fixture 10 to be easily removed. In other embodiments, the lighting fixture may be attached to the frame with clamps, screws or adhesive as well. Although the embodiments described here are meant for indoor use, the present invention can also be configured for outdoor applications. Additionally, the present invention can be used in conjunction with various mounting systems besides the mounting system described here.

Figure 5:
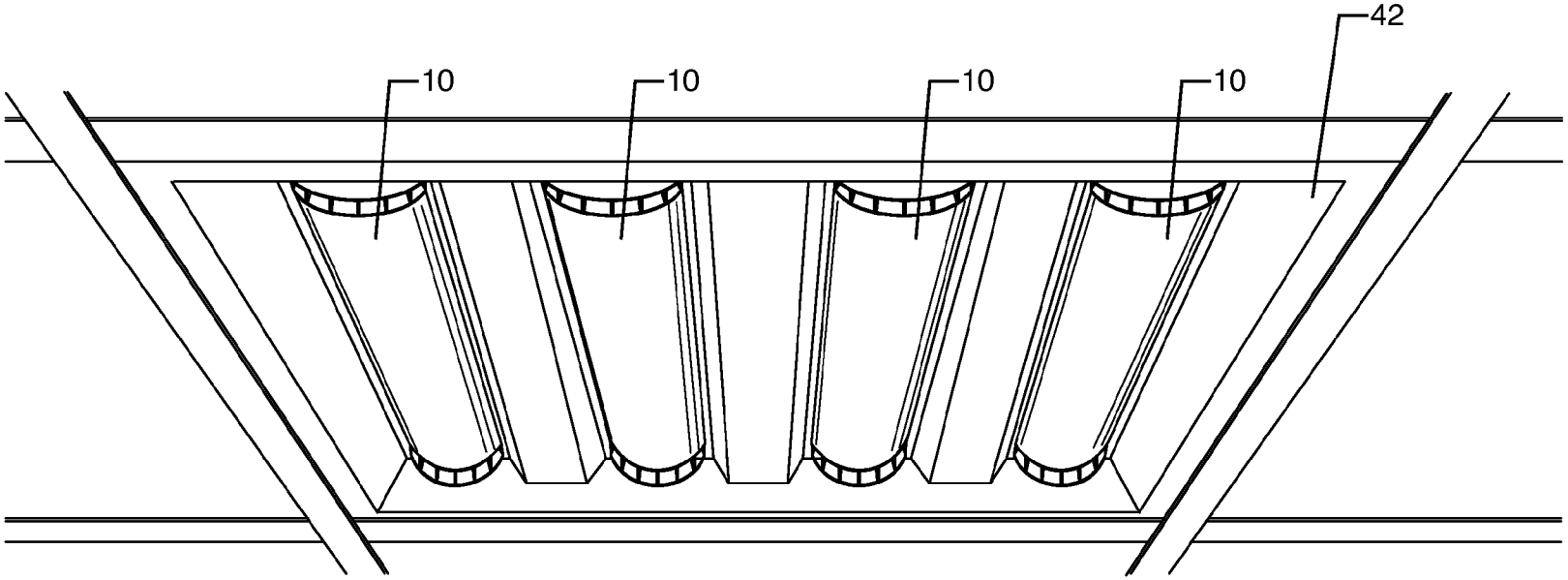
FIG. 5 is an environmental view of the present invention illustrating the lighting fixture fitted into a panel with multiple apertures.
Figure 6:
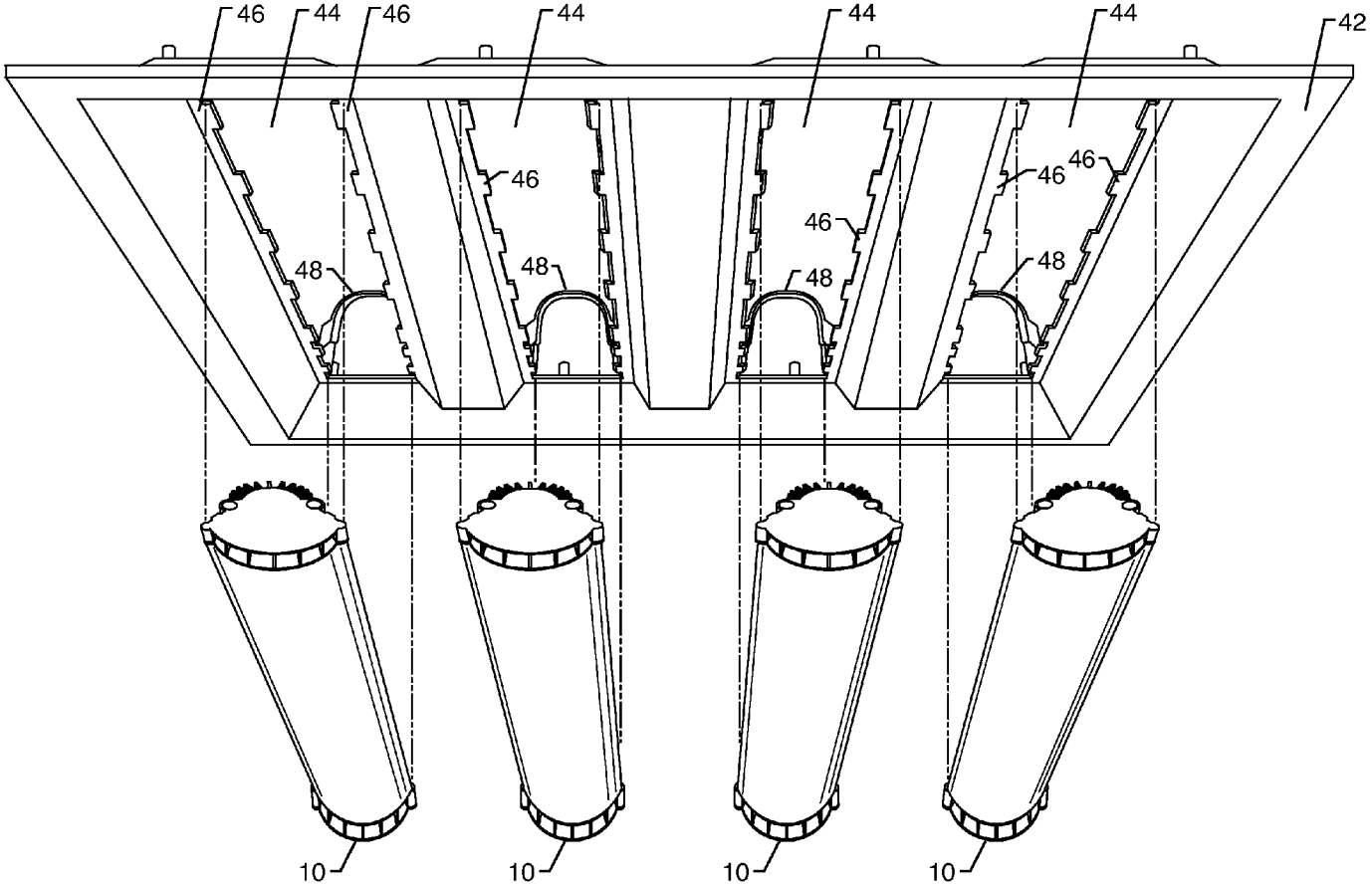
FIG. 6 is a further environmental view as in FIG. 5 illustrating how the lighting fixtures are fit into the panel with multiple bracketed apertures.

FIG. 5 is still another environmental view of the present invention. Here, the passive cooling lighting fixture 10 is shown in a series fitted into a spacing panel 42 that features multiple apertures 44. In this embodiment, the spacing panel 42 is approximately the same size as a ceiling panel tile from a standard drop-down ceiling that is common in commercial real estate. In other embodiments (not shown), the spacing panel can be any size as long as the spacing panel is large enough to fit the passive cooling lighting fixture. The apertures 44 of the spacing panel 42 are illustrated more particularly in FIG. 6. FIG. 6 shows how the lighting fixtures 10 fit inside the panel apertures 44. Also shown in FIG. 6 are the aperture brackets 46. These brackets serve to snap the lighting fixtures 10 in place so that they will not fall out of the panel 42. Each aperture 44 also features a guard 48. Each guard 48 is located at one end of each aperture 44 and functions to keep the lighting fixture 10 from being pushed too far into the aperture.

Figure 7:
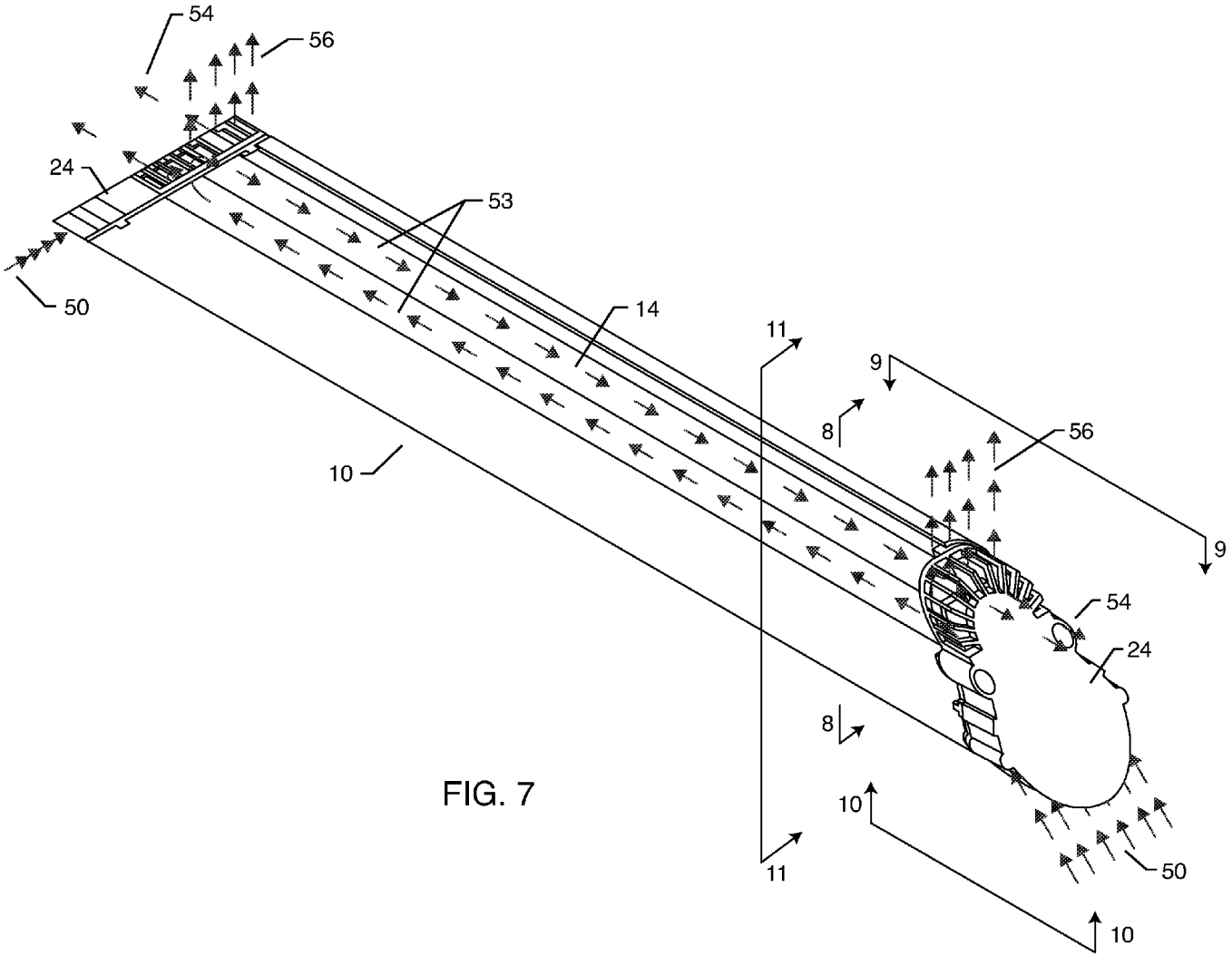
FIG. 7 is a perspective view of the present invention illustrating air flow through the innovative heat sinks featured therein.

The air flow described in FIG. 2 is further illustrated in FIGS. 7-11. In FIG. 7, air flow along the entire length of the lighting fixture 10 is illustrated. First, cool air from outside the lighting fixture enters the end caps 24 through the end cap distal vents 34 along lines 50. Next, air along the inner chamber 14 created by the doubled walled portion of the rigid channel 12 is heated when the LED light source 16 is powered on. This air becomes heated because the LED light source 16 is attached to the outside of one of the walls of the inner chamber 14 created by the double walled portion of the rigid channel 12. The light source 16 gives off energy in the form of heat as it produces light, and this heat is transferred through the wall that the light source 16 is attached to. The direction of the flow of heated air along the inner chamber 14 is indicated by lines 52. This heated air moves toward the end caps 24 located at both ends of the rigid channel 12 and exits the inner chamber via the end cap ports 36. Finally, the heated air is drawn out of the lighting fixture through the end cap base vents 32 along lines 54 and 56 along with the cool air that entered from the distal vents 34. The angled placement of the end caps 24 relative to the rigid channel 12 assists with the flow of the cool air from the distal vents of the end cap 34 to the base vents of the end cap 32.

Figure 8:
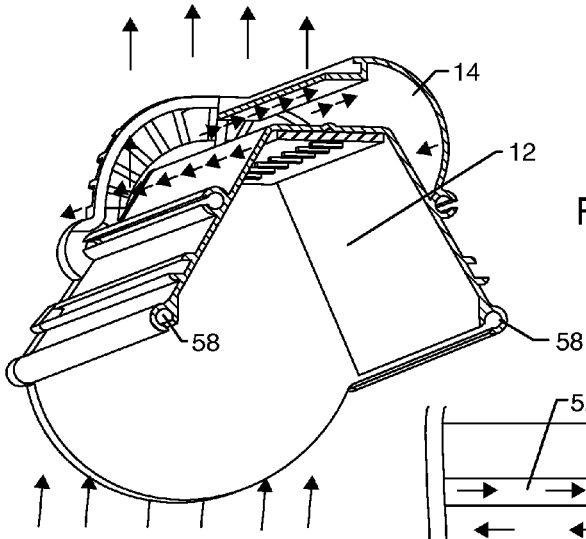
FIG. 8 is a cut-away perspective view along line 8 of FIG. 7 illustrating the direction of air flow through the inner chamber and end caps of the present invention.
Figure 9:
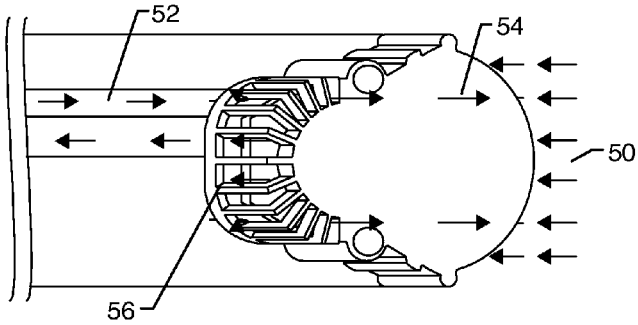
FIG. 9 is a top perspective view along line 9 of FIG. 7 illustrating the direction of air flow through the end caps of the present invention.

FIG. 8 is a cutaway perspective view taken from FIG. 7 along line 8. Here, it can be seen that hot air can flow in both directions along the inner chamber 14. FIG. 8 also better illustrates the c-shaped concourse 58 that allows the light diffusing lens 22 to slide into place over the rigid channel 12 and remain in place without falling off. FIG. 9 is another cutaway perspective view taken from FIG. 7 along line 9. FIG. 9 shows a top-down view of the end cap 24 showing the directions of air flow through the lighting fixture 10. As described above, the cool air enters the end cap 24 along lines 50. The cool air draws out the hot air taken along lines 52. The air is finally vented out of the lighting fixture along lines 54 and 56.

Figure 10:
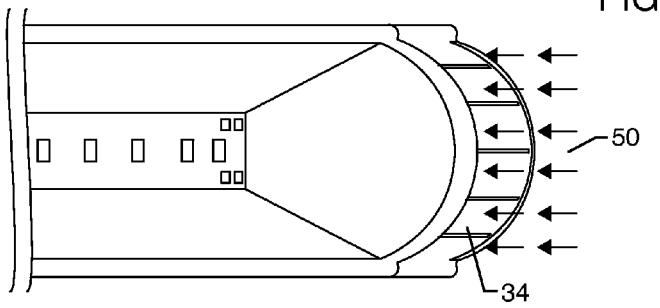
FIG. 10 is a bottom perspective view along line 10 of FIG. 7 illustrating the direction of air flow through the end caps of the present invention.
Figure 11:
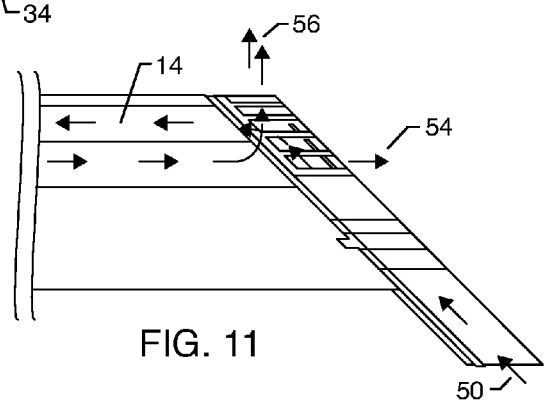
FIG. 11 is a side perspective view along line 11 of FIG. 7 illustrating the direction of air flow through the end caps of the present invention.

FIG. 10 shows a bottom-up view of one end of the lighting fixture 10 taken along line 10 of FIG. 7. FIG. 10 illustrates how the placement of the distal end cap vents 34 and the angle of the end cap 24 help to direct cooler air taken along lines 50 from outside the lighting fixture 10 into the end cap 24 so as to circulate hot air away from the LED light source 16. FIG. 11 is a side view of one end of the lighting fixture 10 taken along line 11 of FIG. 7. FIG. 11 more closely shows how air circulates into and out of the inner chamber 14. FIG. 11 also shows how the circulated air leaves the lighting fixture 10 either horizontally or vertically out of the base end cap vents 32, as shown by lines 54 and 56.

The present invention is a passive cooling lighting fixture that overcomes several of the shortcomings that have been common to lighting fixtures in the past. First, the passive cooling lighting fixture includes a light source that features a plurality of LED lights. These LED lights require less energy than both incandescent and fluorescent light bulbs. LED lights cycle on and off quicker than fluorescent light bulbs, and they do not generate as much heat as incandescent light bulbs. Despite their advantages, LED lights produce a light that is very bright and oftentimes very glaring. Additionally, LED lights produce some heat. If that heat is not sinked away, the LED light will experience a shorter life span as well as possible unexpected failure. The present invention houses its plurality of LED lights in a rigid channel that is covered by a light diffusing lens. The light diffusing lens creates a light from the LEDs that is more appropriate for indoor use because it is softer and not glaring. The light fixture of the present invention also solves the heating problem common to LED lights by providing a passive cooling system that sinks the heat away from the LED lights. The cooling system operates by circulating air through a chamber that heats up as the LED lights are powered on. The circulation of the air through the chamber is accomplished by a pair of end caps that include both distal and base vents. As cool air enters the end cap through the distal vents, it circulates through the chamber drawing hot air out through the base vents of the end cap. The angle of the end caps in relation to the rigid channel helps create the upward draft necessary to circulate the cool air into the lighting fixture and the hot air out.

Although several embodiments have been described in detail for purposes of illustration, various modifications may be made without departing from the scope and spirit of the invention. Accordingly, the invention is not to be limited, except as by the appended claims.

What is claimed is:

1. A lighting fixture, comprising:

an elongated channel having a base, two side walls and two open ends;

an outer wall substantially co-extensive with the base of the elongated channel forming an inner chamber having two open ends;

a light source mounted within the elongated channel and disposed along the base;

two double walled end caps having a plurality of vents and two inner ports, wherein one double walled end cap is disposed over each of the two open ends of both the elongated channel and the inner chamber; and a semi-opaque lens fitted over the elongated channel, between the two side walls and the two end caps wherein the elongated channel is completely enclosed by the semi-opaque lens.

2. The lighting fixture of claim 1, wherein the elongated channel is made of a heat-conducting material.

3. The lighting fixture of claim 1, wherein the inner surface of the elongated channel is reflective.

4. The lighting fixture of claim 1, wherein the light source comprises a plurality of surface mounted light emitting diodes.

5. The lighting fixture of claim 4, wherein the plurality of surface mounted light emitting diodes are configured on a strip that is wholly contained within the elongated channel.

6. The lighting fixture of claim 1, wherein the plurality of vents in the double walled end caps are oriented along the base end and the distal end of the double walled end caps.

7. The lighting fixture of claim 1 wherein the two inner ports of the double walled end caps are oriented at the base end of the double walled end caps, such that the inner ports are over the open ends of the inner chamber.

8. The lighting fixture of claim 7, wherein the plurality of vents and the two inner ports of the double walled end caps and the inner chamber form an air circulation pathway.

9. The lighting fixture of claim 1, wherein the distal ends of the double walled end caps are outwardly angled from the elongated channel relative to the base ends of the end caps.

10. The lighting fixture of claim 1, wherein the semi-opaque panel is made of a light diffusing material.

11. The lighting fixture of claim 10, wherein the light diffusing material is plastic.

12. The lighting fixture of claim 1, wherein the semi-opaque panel is curved.

13. The lighting fixture of claim 1, further comprising a frame including means for securing the elongated channel to a ceiling such that the elongated channel hangs below the ceiling.

14. The lighting fixture of claim 13, wherein the securing means includes clamps, screws, brackets, and adhesive.

15. The lighting fixture of claim 1, further comprising a panel with a plurality of bracketed apertures wherein the size of each aperture corresponds with the size of the elongated channel such that an elongated channel can be secured within an aperture and multiple elongated channels can be secured to the panel.

16. The lighting system of claim 15, wherein each bracketed aperture further comprises a guard that prevents the elongated channel from being pushed through the aperture.

17. A lighting fixture, comprising:

an elongated channel having a base, two side walls and two open ends, wherein the channel is made of a heat-conducting material;

an outer wall substantially co-extensive with the base of the elongated channel forming an inner chamber having two open ends;

a plurality of surface mounted light emitting diodes configured on a strip that is wholly contained within the elongated channel;

two double walled end caps having a plurality of vents and two inner ports, wherein one double walled end cap is disposed over each of the two open ends of both the elongated channel and the inner chamber; and a semi-opaque lens fitted over the elongated channel, between the two side walls and the two end caps wherein the elongated channel is completely enclosed by the semi-opaque lens.

18. The lighting fixture of claim 17, further comprising a panel with a plurality of bracketed apertures wherein the size of each aperture corresponds with the size of the elongated channel such that an elongated channel can be secured within an aperture and multiple elongated channels can be secured to the panel.

19. A lighting fixture, comprising:

an elongated channel having a base, two side walls and two open ends, wherein the channel is made of a heat-conducting material;

an outer wall substantially co-extensive with the base of the elongated channel forming an inner chamber having two open ends;

a plurality of surface mounted light emitting diodes configured on a strip that is wholly contained within the elongated channel;

two double walled end caps having a plurality of vents that are oriented along the base end and the distal end of the double walled end caps and two inner ports that are oriented at the base end of the double walled caps, such that the inner ports are over the open ends of the inner chamber; and a semi-opaque lens fitted over the elongated channel, between the two side walls and the two end caps wherein the elongated channel is completely enclosed by the semi-opaque lens.

20. The lighting fixture of claim 19, further comprising a panel with a plurality of bracketed apertures wherein the size of each aperture corresponds with the size of the elongated channel such that an elongated channel can be secured within an aperture and multiple elongated channels can be secured to the panel.

* * * * *